US006526122B2

(12) United States Patent
Matsushita et al.

(10) Patent No.: US 6,526,122 B2
(45) Date of Patent: Feb. 25, 2003

(54) X-RAY TUBE

(75) Inventors: Tadaoki Matsushita, Hamamatsu (JP); Tutomu Inazuru, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/755,090

(22) Filed: Jan. 8, 2001

(65) Prior Publication Data

US 2001/0002208 A1 May 31, 2001

Related U.S. Application Data

(63) Continuation-in-part of application No. PCT/JP99/03674, filed on Jul. 7, 1999.

(30) Foreign Application Priority Data

Jul. 9, 1998 (JP) ..... 10-194365
Jul. 30, 1998 (JP) ..... 10-215657

(51) Int. Cl.[7] ..... H01J 35/14
(52) U.S. Cl. ..... 378/138; 378/121
(58) Field of Search ..... 378/138, 136, 378/137, 121; 313/238, 239, 289

(56) References Cited

U.S. PATENT DOCUMENTS 4,281,270 A * 7/1981 Abeles ..... 313/444
4,621,213 A 11/1986 Rand ..... 313/237
4,720,654 A * 1/1988 Hernqvist et al. ..... 313/414
5,118,983 A * 6/1992 Morita et al. ..... 313/340
5,517,545 A * 5/1996 Nakamura et al. ..... 378/101
5,563,923 A * 10/1996 Okada et al. ..... 378/138

FOREIGN PATENT DOCUMENTS

GB 2021310 11/1979
JP 54-150997 11/1979
JP 63-91943 4/1988

* cited by examiner

*Primary Examiner*—Drew A. Dunn
*Assistant Examiner*—Chih-Cheng Glen Kao
(74) *Attorney, Agent, or Firm*—Morgan, Lewis & Bockius LLP

(57) ABSTRACT

An X-ray tube 1 includes spacer 8 which is cylindrical so it does not block electrons 80 directed from a grid electrode 72 toward a focusing electrode 25, and which has one end 8*b* fixed to the grid electrode 72 and the other end 8c abutting against the focusing electrode 25. The distance between the grid electrode 72 and focusing electrode 25 is set to a predetermined distance by the spacer 8.

2 Claims, 6 Drawing Sheets

X-RAY TUBE

RELATED APPLICATIONS

The present application is a continuation-in-part application of PCT application No. PCT/JP99/03674 filed on Jul. 7, 1999, designating U.S.A. and now pending.

BACKGROUND OF THE INVENTION

1. Field of the Invention

The present invention relates to an X-ray tube for generating X-rays.

2. Related Background Art

An X-ray tube has an electron gun comprised of a cathode, heater, grid electrode, and the like, a focusing electrode, and an anode target in a high-vacuum sealed housing (tube). The cathode is heated by the heater to emit electrons from the cathode. The electrons are focused through the grid electrode and focusing electrode to become incident on the anode target to which a high voltage is applied, thereby generating X-rays.

In the assembly of the X-ray tube, the position (position in the electron traveling direction) of the electron gun is determined by inserting the electron gun in the housing to oppose the focusing electrode integrated with the housing, and the lid portion which is opposite to the cathode of the electron gun is fixed to the housing, so that the housing is sealed.

In the X-ray tube, an electron beam from the electron gun must be focused to about 10 $\mu$m on the anode target so that predetermined X-rays are obtained. In order to obtain this predetermined focal diameter, the distance between the focusing electrode and the grid electrode of the electron gun must be set to a predetermined distance highly precisely.

SUMMARY OF THE INVENTION

In the X-ray tube described above, when the electron gun is inserted in the housing to oppose the focusing electrode, the housing is closed with the lid portion of the electron gun, and accordingly the actual distance between the grid and focusing electrodes cannot be measured or inspected. It is therefore very difficult to set the distance between the grid and focusing electrodes to the predetermined distance highly precisely by positioning adjustment of the electron gun, and positioning adjustment of the electron gun takes a very long period of time. For example, if the grid electrode is displaced by about 100 $\mu$m from the predetermined distance, the predetermined focal diameter (about 10 $\mu$m) cannot be obtained.

It is an object of the present invention to solve the problems described above and to provide an X-ray tube in which the grid electrode can be positioned in the axial direction (direction along which electrodes line up) precisely and easily, so that an improvement in quality and reduction in assembly cost can be realized.

In order to solve the above problems, according to the present invention, there is provided an X-ray tube in which a cathode is heated in a housing sealed in vacuum to emit electrons, and the electrons are focused on an anode target through a grid electrode and a focusing electrode, thereby generating X-rays, characterized by comprising a spacer with one end fixed to the grid electrode and the other end abutting against the focusing electrode, the spacer being formed cylindrical so the electrons directed from the grid electrode toward the focusing electrode can pass therethrough.

In the X-ray tube according to the present invention, because of the presence of the spacer formed cylindrical so it does not block the electrons directed from the grid electrode toward the focusing electrode, and with one end fixed to the grid electrode and the other end abutting against the focusing electrode, the distance between the grid electrode and focusing electrode is set to a predetermined distance. The grid electrode can accordingly be positioned in the axial direction (direction along which electrodes line up) correctly and easily. As a result, an improvement in quality of the X-ray tube and reduction in assembly cost can be realized.

Also, in order to solve the above problems, according to the present invention, there may also be provided an X-ray tube in which a cathode is heated in a housing sealed in vacuum to emit electrons, and the electrons are focused on an anode target through a grid electrode and a focusing electrode, thereby generating X-rays, characterized in that the grid electrode has a plate-shaped base portion with an opening, at a center thereof, through which the electrons pass, and a cylindrical portion integrally molded with the base portion from the same material as that of the base portion, formed cylindrical so the electrons directed from the opening toward the focusing electrode can pass therethrough, and having one end abutting against the focusing electrode.

In the X-ray tube according to the present invention, the distance between the base portion of the grid electrode, which has the opening through which the electrons from the cathode pass and forms a microelectron lens for obtaining a predetermined focal point, and the focusing electrode is set to a predetermined distance by the cylindrical portion of the grid electrode, which is formed cylindrical so as not to block the electrons directed from the opening of the base portion toward the focusing electrode and integrally molded with the base portion so the end thereof abuts against the focusing electrode. Therefore, the base portion (microelectron lens) of the grid electrode can be positioned in the axial direction (direction along which electrodes line up) correctly and easily. As a result, an improvement in quality of the X-ray tube and reduction in assembly cost can be realized.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Figure 1:
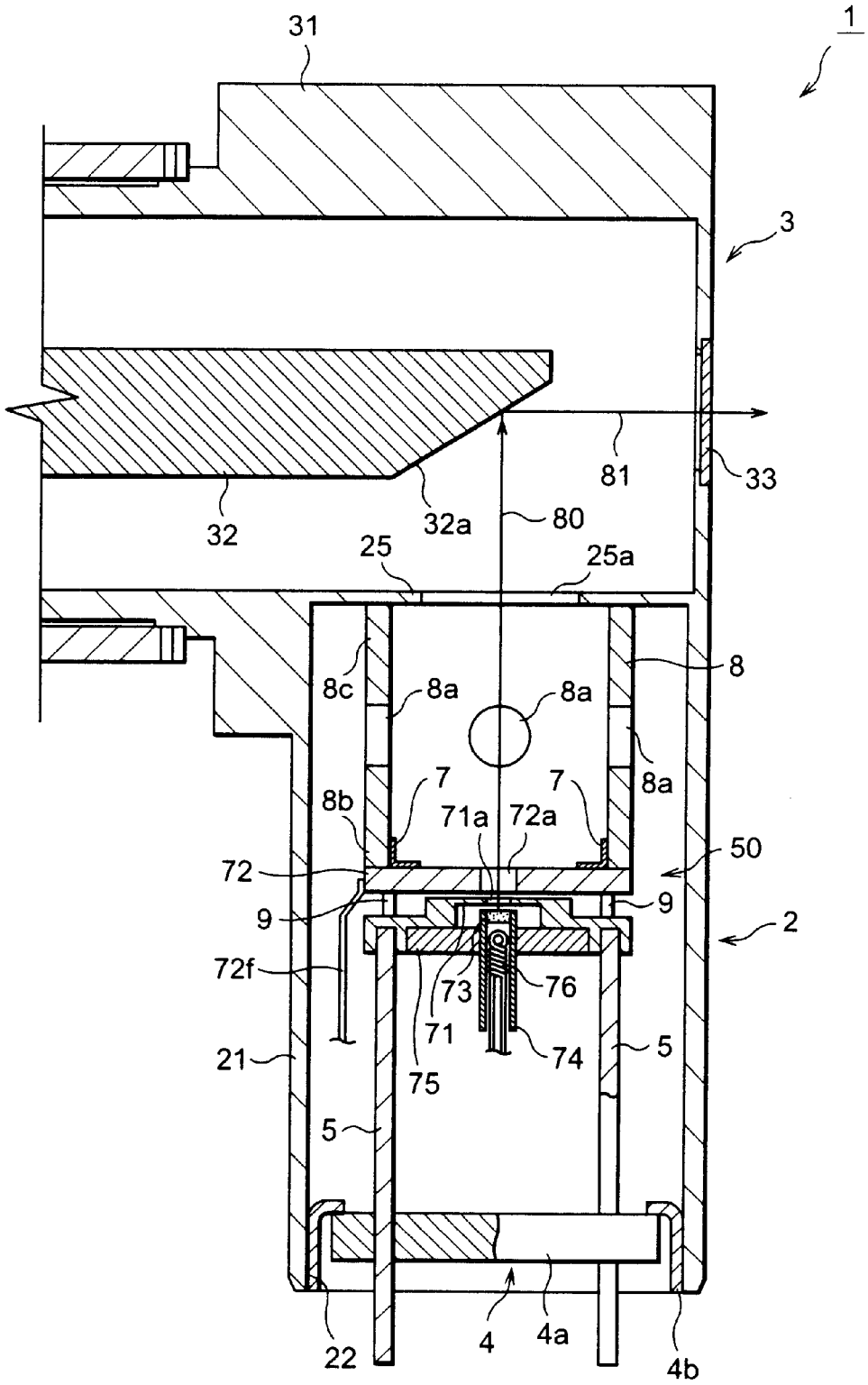
FIG. 1 is a sectional view showing the main part of an X-ray tube according to the first embodiment.

An X-ray tube according to the preferred embodiments of the present invention will be described with reference to the accompanying drawings. Note that in the drawings, identical elements are denoted by the same reference numerals, and repetitive description will be omitted.

(First Embodiment)

FIG. 1 is a sectional view showing the main part of an X-ray tube according to the first embodiment. As shown in FIG. 1, an X-ray tube 1 is a microfocus X-ray tube, and has an electron gun portion 2 for generating and emitting electrons 80, and an X-ray generating portion 3 for generating X-rays 81 upon being bombarded by the electrons 80 from the electron gun portion 2. The outer shells of the electron gun portion 2 and X-ray generating portion 3 are constituted by cylindrical containers 21 and 31 serving as housings that accommodate respective constituent components. The containers 21 and 31 are made of conductors and are connected to each other perpendicularly. The interiors of the containers 21 and 31 are partitioned from each other by a focusing electrode 25 formed at the boundary portion between the containers 21 and 31, and communicate with each other through an opening 25*a* formed in the focusing electrode 25. An electron gun 50 is arranged in the container 21, and an anode target 32 is arranged in the container 31. The containers 21 and 31 are sealed so that their interiors are set in vacuum.

The electron gun 50 arranged in the container 21 roughly has a heater 76 serving as a heat generating source, a cathode 73 serving as a thermoelectron source for generating and emitting the electrons 80 upon being heated by the heater 76, first and second grid electrodes 71 and 72 for accelerating and focusing the electrons 80 emitted from the cathode 73, a spacer 8 interposed between the second grid electrode 72 and focusing electrode 25 to set the distance between them to a predetermined distance, a plurality of pins 5 for supplying a predetermined voltage to the first and second grid electrodes 71 and 72, heater 76, and cathode 73 from the outside of the container, and a stem 4 through and to which the pins 5 extend and are fixed and which serves as the lid portion of the container.

The stem 4, heater 76, cathode 73, first and second grid electrodes 71 and 72, and spacer 8 line up in this order toward the focusing electrode 25, and are arranged such that the axes of these constituent components coincide with each other and are coaxial with the axis of the opening 25*a* of the focusing electrode 25 and the axis of the cylindrical container 21.

This will be described in more detail. The cathode 73 is provided to the distal end of a cylinder 74 made of an insulator, and the heater 76 for heating the cathode 73 is provided in the cylinder 74. The first grid electrode 71 is arranged closer to the focusing electrode 25 than the cathode 73 is, and the second grid electrode 72 is arranged closer to the focusing electrode 25 than the first grid electrode 71 is. The second grid electrode 72 is supported by the first grid electrode 71 on the focusing electrode 25 side through a plurality of ceramic rods (insulators) 9. The cylinder 74 having the cathode 73 and heater 76 is supported through an insulator 75 on that side of the first grid electrode 71 which is opposite to the focusing electrode 25.

Figure 2:
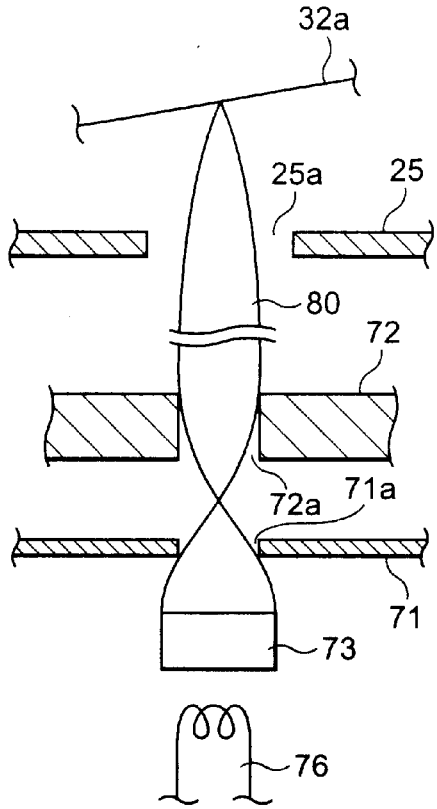
FIG. 2 is a view showing the behavior of an electron beam from a cathode to an anode target.

Both the first and second grid electrodes 71 and 72 form circular disks, and respectively have openings 71*a* and 72*a*, through which the electrons 80 from the cathode 73 pass, at positions opposing the cathode 73. The second grid electrode 72 is an electrode for attracting the electrons 80 from the cathode 73 toward the target 32 in the container 31. The first grid electrode 71 is an electrode for pushing back the electrons 80, attracted toward the target 32 by the second grid electrode 72, toward the cathode 73. When a voltage to be supplied to the first grid electrode 71 is adjusted, the electrons 80 directed toward the target 32 are increased or decreased. As shown in FIG. 2, the openings 71*a* and 72*a* of the first and second grid electrodes 71 and 72 constitute a microelectron lens group that focuses the electrons 80 from the cathode 73 onto the target 32.

Referring back to FIG. 1, the spacer 8 as a characteristic feature of this embodiment is interposed between the second grid electrode 72 and focusing electrode 25. The spacer 8 is cylindrical so the electrons 80 directed from the cathode 73 toward the target 32 can pass through it, and has a predetermined length in the axial direction. The spacer 8 has one end 8*b* fixed to the end face of the second grid electrode 72, and the other end 8*c* abutted against the focusing electrode 25. As the spacer 8 with the predetermined length is interposed between the second grid electrode 72 and focusing electrode 25, the distance between them is set to a predetermined distance. The predetermined distance in this case refers to the distance between the second grid electrode 72 and focusing electrode 25 which is necessary for obtaining a desired focal diameter.

The spacer 8 is made of, e.g., a conductor such as stainless steel, and the second grid electrode 72 for fixing it is made of, e.g., Mo (molybdenum) with good heat resistance. In this manner, according to this embodiment, since Mo which is difficult to weld with ordinary welding is used to form the second grid electrode 72, the second grid electrode 72 and spacer 8 are connected to each other in accordance with resistance welding by using a plurality of Ni (nickel) ribbons 7. Connection using the Ni ribbons 7 is done between the end face of the second grid electrode 72 and the inner circumferential surface of one end 8*b* of the spacer 8.

The spacer 8 has, in its circumferential wall, a plurality of vent holes 8a for allowing the space portion on the target 32 side and the space portion on the cathode 73, which are defined by the spacer 8 and the second grid electrode 72 for fixing the spacer 8 as the boundary portion, to communicate with each other.

The first grid electrode 71 described above has the plurality of pins 5 vertically extending on its side opposite to the target 32. The pins 5 extend through a circular disk-shaped stem substrate 4*a* made of an insulator, e.g., a ceramic material, and are fixed to the stem substrate 4*a*. In other words, the first grid electrode 71 for supporting the spacer 8, second grid electrode 72, cylinder 74, and the like is supported by the stem substrate 4*a* through the plurality of pins 5.

Another plurality of pins (not shown) also extend through the stem substrate 4*a* and are fixed to it.

These other plurality of pins are connected to a lead wire 72*f* of the second grid electrode 72 and the lead wires (not shown) of the cathode 73 and heater 76. An annular stem ring 4*b* is bonded to the outer periphery of the stem substrate 4*a*.

The electron gun 50 is formed in the above manner. The stem ring 4*b* of the electron gun 50 is fixed to an opening portion 22, formed at the end of the container 21, by, e.g., brazing. Since the stem ring 4*b* is fixed to the opening portion 22 of the container 21, the opening portion 22 is closed by the stem 4 comprised of the stem substrate 4*a* and stem ring 4*b*, so that the containers 21 and 31 are sealed.

A predetermined negative voltage is supplied to the first grid electrode 71 from the outside of the container through the pins 5 described above. A predetermined voltage is supplied to the heater 76 and cathode 73 from the outside of the container through other pins and lead wires. A ground potential is supplied to the second grid electrode 72 from the outside of the container through other pins and the lead wire 72*f*. The ground potential supplied to the second grid electrode 72 is also supplied to the spacer 8, focusing electrode 25, and containers 31 and 21 electrically connected to it.

Figure 3:
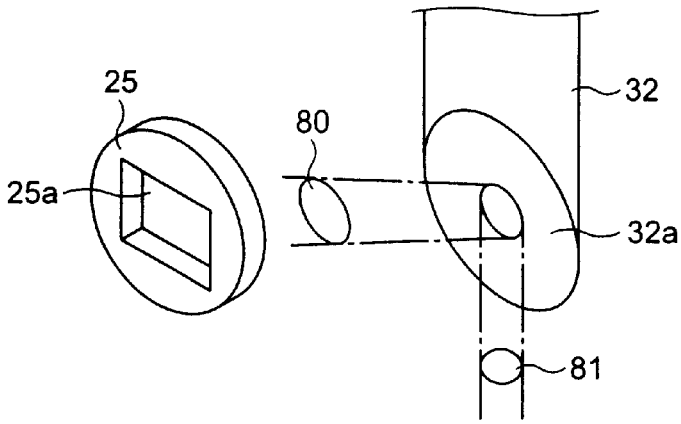
FIG. 3 is a view showing the behavior of an electron beam which becomes incident on the anode target through a focusing electrode and that of X-rays emitted from the anode target.

As shown in FIG. 3, the opening 25*a* of the focusing electrode 25 located at the boundary between the containers 21 and 31 is formed into a rectangular shape to shape the electron beam focused by the first and second grid electrodes 71 and 72 to have an elliptic spot.

As shown in FIG. 1, the target 32 is set in the container 31 that communicates with the interior of the container 21 through the opening 25*a* of the focusing electrode 25. The target 32 generates the X-rays 81 upon being bombarded by the electrons 80 from the electron gun 50. The target 32 forms a metal rod-like body and is arranged such that its axial direction intersects a direction from which the electrons 80 enter. A distal end face 32*a* of the target 32 is a surface that receives the electrons 80 from the electron gun 50. The distal end face 32*a* is arranged at a position in front of the entering electrons 80, and forms a slant surface such that the incident electrons 80 and the emitted X-rays 81 are perpendicular to each other. A positive high voltage is applied to the target 32.

The container 31 has an X-ray exit window 33. The X-ray exit window 33 is a window for emitting the X-rays 81 generated by the target 32 to the outside of the container 31, and is formed of, e.g., a plate body or the like made of a Be material as an X-ray permeable material. The X-ray exit window 33 is arranged in front of the distal end of the target 32, and is formed such that its center is located on the extension of the central axis of the target 32.

How to assemble the X-ray tube 1 will be described. First, the operator assembles the electron gun 50 excluding the spacer 8 and stem ring 4*b*, fixes the spacer 8, which is formed with a predetermined length in advance such that its size precision in the axial direction has a high precision, to the second grid electrode 72 in accordance with resistance welding using the ribbons 7, and bonds the stem ring 4*b* to the stem substrate 4*a*. The operator then arranges the target 32 in the container 31, and inserts the assembled electron gun 50 into the container 21 through the opening portion 22.

The operator then inserts the electron gun 50 until abutment, i.e., until the other end 8*c* of the spacer 8 abuts against the focusing electrode 25. When the other end 8*c* of the spacer 8 abuts against the focusing electrode 25, the distance between the second grid electrode 72 and focusing electrode 25 is set to a predetermined distance, which is necessary for obtaining a desired focal diameter, by the spacer 8.

After the electron gun 50 is positioned in the axial direction in the above manner, the stem ring 4*b* is bonded to the opening portion 22 of the container 21 to seal the containers 21 and 31.

In this manner, according to this embodiment, the second grid electrode 72 (electron gun 50) can be positioned in the axial direction correctly and easily because of the spacer 8.

The interiors of the containers 21 and 31 of the assembled X-ray tube 1 are set to a vacuum state, as described above. Evacuation of the interiors of the containers 21 and 31 to vacuum is performed from the container 21 or 31. In this case, since the space portion on the target 32 side and the space portion on the cathode 73, which are defined by the spacer 8 and the second grid electrode 72 as the boundary portion, communicate with each other through the plurality of vent holes 8*a* of the spacer 8 described above, this evacuation can be performed easily.

The operation of the X-ray tube 1 with the above arrangement will be described. First, the X-ray tube 1 is dipped in a cooling medium, e.g., insulating oil, and the heater 76 is heated while a negative voltage, ground potential, and positive high voltage are respectively supplied to the first grid electrode 71, second grid electrode 72, and target 32. Then, the cathode 73 emits the electrons 80. The electrons 80 are accelerated and focused through the openings 71*a* and 72*a* of the first and second grid electrodes 71 and 72, and pass through the opening 25*a* of the focusing electrode 25 (see FIG. 2).

As the opening 25*a* of the focusing electrode 25 has a rectangular shape, as shown in FIG. 3, the electron beam that has passed through the opening 25*a* becomes an elliptic-spot beam and is focused and becomes incident on the distal end face 32*a* of the target 32. Since the distal end face 32*a* forms a slant surface, the X-rays 81 emitted from the distal end face 32*a* form a true circle. The X-rays 81 are then emitted to the outside of the X-ray tube 1 through the X-ray exit window 33.

As described above, the distance between the second grid electrode 72 and focusing electrode 25 is set to a predetermined distance by the spacer 8, and the second grid electrode 72 (electron gun 50) is positioned accurately in the axial direction. Thus, a predetermined focal diameter can be obtained on the distal end face 32*a* of the target 32, so that the predetermined X-rays 81 can be obtained.

Extra X-rays emerging from the distal end face 32*a* of the target 32 toward the cathode 73 through the opening 25*a* of the focusing electrode 25 are blocked from the cathode 73 side by the cylindrical spacer 8 and the second grid electrode 72 which fixes the spacer 8. Thus, X-ray leakage from the container 21 can be prevented more reliably.

Since the X-ray tube 1 is dipped in the insulating oil, heat of the second grid electrode 72 is dissipated positively to the insulating oil through the spacer 8 fixed to the second grid electrode 72, the focusing electrode 25 against which the spacer 8 abuts, and the containers 21 and 31, so that abnormal heat generation by the second grid electrode 72 can be prevented.

If the spacer 8 is a non-conductor, when the X-ray tube 1 operates, the spacer 8 is electrically charged, and the electrons 80 from the cathode 73 may not be correctly focused on the distal end face 32*a* of the target 32. In this embodiment, since the spacer 8 is a conductor and the ground potential is supplied to the spacer 8 through the second grid electrode 72, abnormal charging of the spacer 8 is prevented, and the electrons 80 from the cathode 73 can be correctly focused on the distal end face 32*a* of the target 32.

Since the ground potential is also supplied to the containers 21 and 31 through the second grid electrode 72, spacer 8, and focusing electrode 25, no ground potential need be supplied to the containers 21 and 31 by using another ground potential supply means, leading to a reduction in number of components.

(Second Embodiment)

Figure 4:
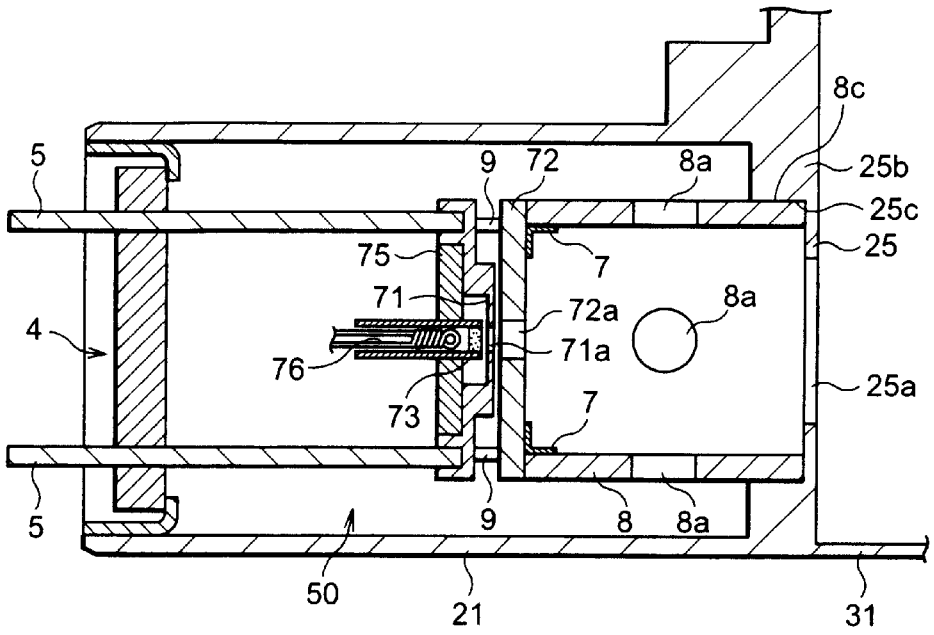
FIG. 4 is a sectional view showing the main part of an X-ray tube according to the second embodiment.

FIG. 4 is a sectional view showing the main part of an X-ray tube according to the second embodiment. The X-ray tube of the second embodiment is different from that of the first embodiment (see FIG. 1) in that that outer circumferential portion of a focusing electrode 25 which is on the cathode 73 side is formed thick and that an inner circumferential surface 25*c* of this thick-walled portion 25*b* forms a fitting surface which is adapted to fit on the outer circumferential surface of the other end 8*c* of a spacer 8.

The inner circumferential surface 25*c* of the thick-walled portion 25*b* is formed such that its axis coincides with the axes of the constituent components of an electron gun 50 and the axis of an opening 25*a* of the focusing electrode 25.

With the outer circumferential surface of the other end 8*c* of the spacer 8 fitting with the inner circumferential surface 25*c* of the thick-walled portion 25*b*, the other end 8*c* abuts against the end face of the focusing electrode 25, in the same manner as in the first embodiment.

With this arrangement as well, the same effect as that of the first embodiment can be naturally obtained. In addition, since the other end 8*c* of the spacer 8 fits on the focusing electrode 25, the other end 8*c* can be positioned correctly and easily in a direction (vertical direction in FIG. 4) perpendicular to a direction along which electrodes line up.

Because of this fitting, the other end 8*c* of the spacer 8 and a second grid electrode 72 are supported by the focusing electrode 25, thereby improving the vibration resistance.

(Third Embodiment)

Figure 5:
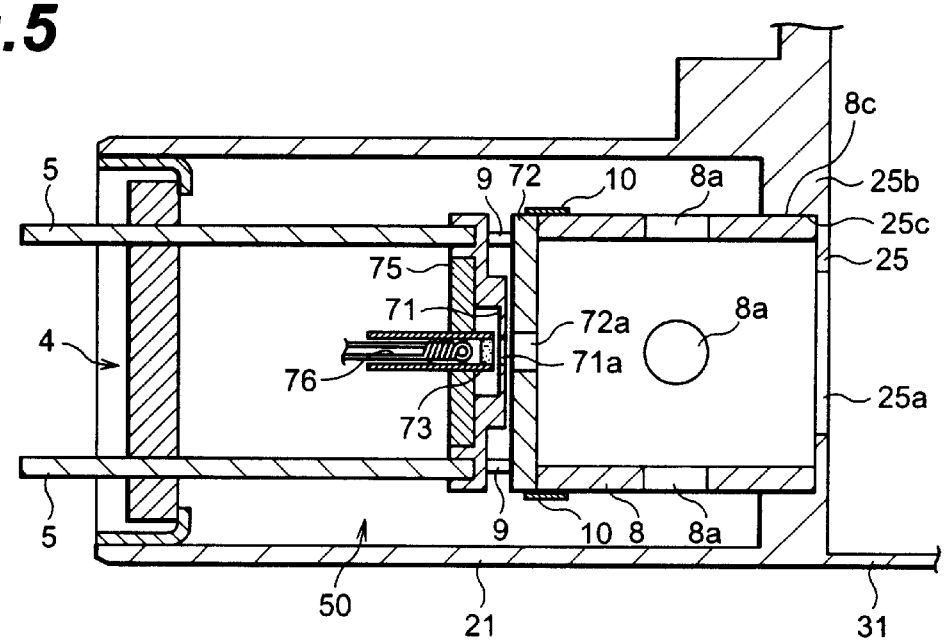
FIG. 5 is a sectional view showing the main part of an X-ray tube according to the third embodiment.

FIG. 5 is a sectional view showing the main part of an X-ray tube according to the third embodiment. The X-ray tube of the third embodiment is different from that of the second embodiment (see FIG. 4) in that the outer circumferential surface of a second grid electrode 72 is connected to the outer circumferential surface of one end 8b of a spacer 8 through a plurality of Ni ribbons 10 in place of the Ni ribbons 7.

With this arrangement as well, the same effect as that of the second embodiment can be obtained.

(Fourth Embodiment)

Figure 6:
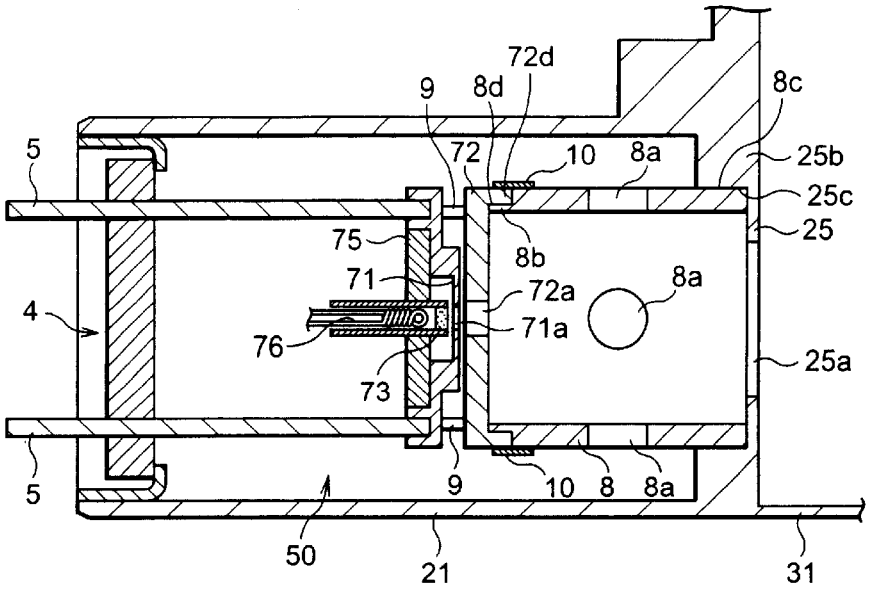
FIG. 6 is a sectional view showing the main part of an X-ray tube according to the fourth embodiment.

FIG. 6 is a sectional view showing the main part of an X-ray tube according to the fourth embodiment. The X-ray tube of the fourth embodiment is different from that of the third embodiment (see FIG. 5) in that a groove 8*d* is formed annularly in the outer circumferential surface of one end 8*b* of a spacer 8, and that a projection 72*d* which is adapted to fit in the groove 8d is formed annularly on a second grid electrode 72 on the spacer 8 side.

In the assembly of an electron gun 50, with the groove 8*d* of one end 8*b* of the spacer 8 fitting with the projection 72*d* of the second grid electrode 72 on the spacer 8 side, the spacer 8 and second grid electrode 72 are connected to each other through Ni ribbons 10.

With this arrangement as well, the same effect as that of the third embodiment can naturally be obtained. In addition, since the groove 8*d* of one end 8*b* of the spacer 8 fits with the projection 72*d* of the grid electrode 72 on the spacer 8 side, the end 8*b* of the spacer 8 can be positioned with respect to the second grid electrode 72 correctly and easily.

(Fifth Embodiment)

Figure 7:
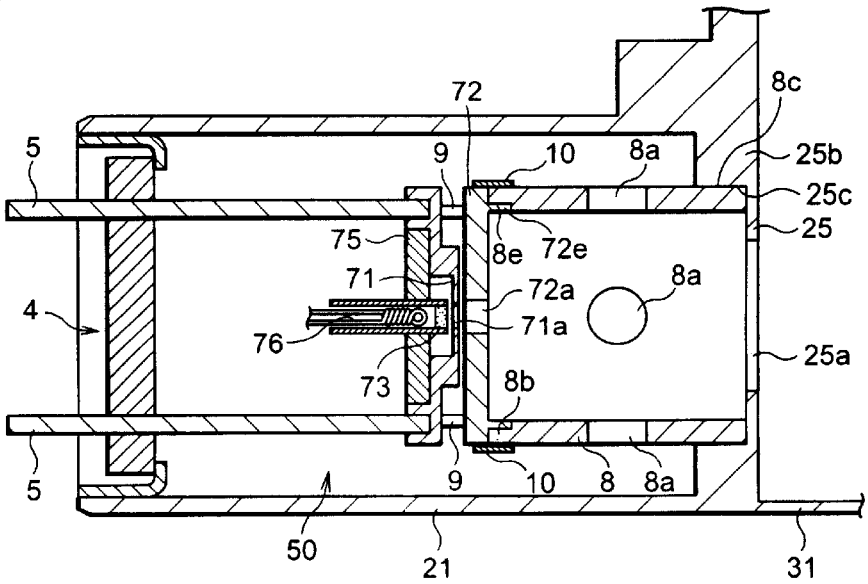
FIG. 7 is a sectional view showing the main part of an X-ray tube according to the fifth embodiment.

FIG. 7 is a sectional view showing the main part of an X-ray tube according to the fifth embodiment. The X-ray tube of the fifth embodiment is different from that of the third embodiment (see FIG. 5) in that a groove 8*e* is formed annularly in the inner circumferential surface of one end 8*b* of a spacer 8, and that a projection 72*e* which is adapted to fit in the groove 8*e* is formed annularly in a second grid electrode 72 on a spacer 8 side.

With this arrangement as well, the same effect as that of the fourth embodiment can naturally be obtained.

In the fourth (see FIG. 6) and fifth (see FIG. 7) embodiments, the outer circumferential surface of the one end 8*b* of the spacer 8 and the outer circumferential surface of the second grid electrode 72 are bonded to each other through the ribbons 10. Alternatively, bonding may be performed on the inner circumferential surface of one end 8*b* of the spacer 8, in the same manner as in the first (see FIG. 1) and second (see FIG. 4) embodiments.

In the first to fifth embodiments described above, since the second grid electrode 72 and spacer 8 are respectively made of Mo and stainless steel, they are preferably fixed by resistance welding using the Ni ribbons 7 or 10. The fixing method is not limited to resistance welding using the Ni ribbons 7 or 10. Particularly, if the second grid electrode 72 is made of a material other than Mo, e.g., stainless steel, ordinary welding or brazing is employed.

(Sixth Embodiment)

Figure 8:
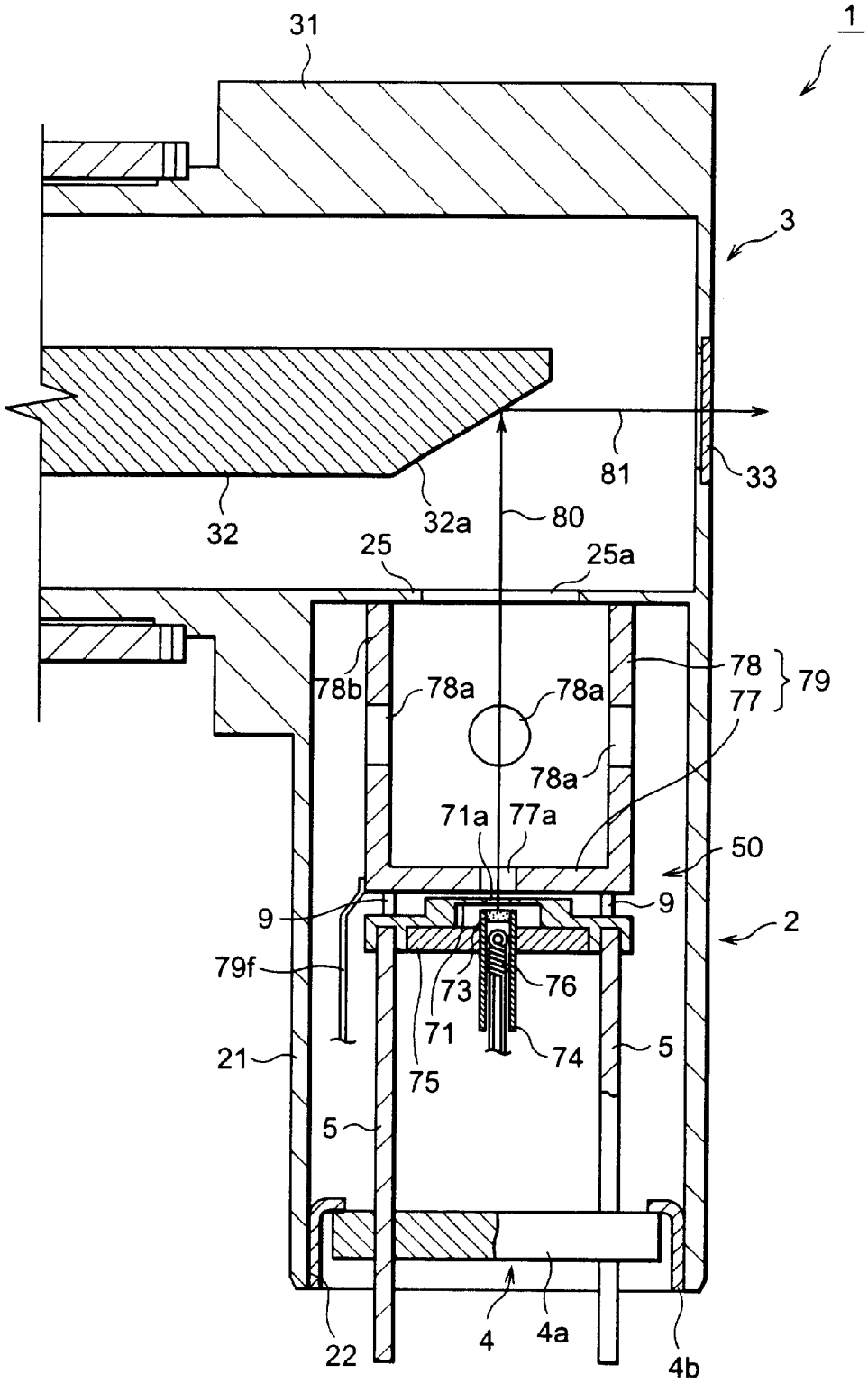
FIG. 8 is a sectional view showing the main part of an X-ray tube according to the sixth embodiment.
Figure 9:
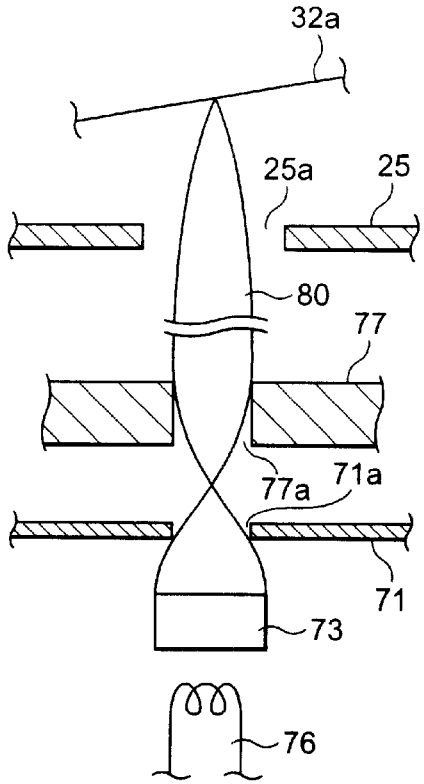
FIG. 9 is a view showing the behavior of an electron beam from a cathode to an anode target.

FIG. 8 is a sectional view showing the main part of an X-ray tube according to the sixth embodiment, and FIG. 9 is a view showing the behavior of an electron beam from a cathode to an anode target in the X-ray tube according to the sixth embodiment. The X-ray tube according to the sixth embodiment is different from that according to the first embodiment in that the X-ray tube according to the first embodiment has the spacer 8 for positioning the second grid electrode 72, whereas the X-ray tube according to this embodiment has no spacer 8 but has a second grid electrode with a specific shape. More specifically, a second grid electrode 79 is comprised of a circular disk-shaped base 77 made of a conductor such as stainless steel, and a cylindrical portion 78 integrally molded with the base 77 from the same material as that of the base 77. The base 77 and cylindrical portion 78 are molded integrally by a forging technique such as back extrusion, or the like. The base 77 is supported by a first grid electrode 71 on the focusing electrode 25 side through a plurality of ceramic rods (insulators) 9.

The first grid electrode and the base 77 of the second grid electrode 79 respectively have openings 71*a* and 77*a*, through which electrons 80 from a cathode 73 pass, at positions opposing the cathode 73. The base 77 of the second grid electrode 79 is an electrode for attracting the electrons 80 from the cathode 73 toward a target 32 in a container 31. The first grid electrode 71 is an electrode for pushing back the electrons 80, attracted toward the target 32 by the base 77 of the second grid electrode 79, toward the cathode 73. When a voltage to be supplied to the first grid electrode 71 is adjusted, the electrons 80 directed toward the target 32 are increased or decreased. As shown in FIG. 9, the opening 71*a* of the first grid electrode 71 and the opening 77*a* of the base 77 of the second grid electrode 79 constitute a microelectron lens group that focuses the electrons 80 from the cathode 73 onto the target 32.

Referring back to FIG. 8, the cylindrical portion 78 integral with the base 77 of the second grid electrode 79 is cylindrical so the electrons 80 directed from the cathode 73 toward the target 32 can pass through it, and has a predetermined length in the axial direction. An open end 78*b* of the cylindrical portion 78 abuts against the focusing electrode 25. As the cylindrical portion 78 with the predetermined length abuts against the focusing electrode 25, the distance between the base 77 of the second grid electrode 79 and the focusing electrode 25 is set to a predetermined distance. The predetermined distance in this case refers to the distance between the base 77 (microelectron lens) of the second grid electrode 79 and the focusing electrode 25 which is necessary for obtaining a desired focal diameter.

The cylindrical portion 78 of the second grid electrode 79 has, in its circumferential wall, a plurality of vent holes 78*a* for allowing the space portion on the target 32 side and the space portion on the cathode 73, which are defined by the cylindrical portion 78 and base 77 as the boundary portion, to communicate with each other.

The first grid electrode 71 described above has a plurality of pins 5 extending on its side opposite to the target 32. The pins 5 extend through a circular disk-shaped stem substrate 4*a* made of an insulator, e.g., a ceramic material, and are fixed to the stem substrate 4*a*. In other words, the first grid electrode 71 for supporting the second grid electrode 79, a cylinder 74, and the like is supported by the stem substrate 4*a* through the plurality of pins 5.

Another plurality of pins (not shown) also extend through the stem substrate 4*a* and are fixed to it. These other plurality of pins are connected to a lead wire 79*f* of the second grid electrode 79 and the lead wires (not shown) of the cathode 73 and of a heater 76. An annular stem ring 4*b* is bonded to the outer periphery of the stem substrate 4*a*.

A predetermined negative voltage is supplied to the first grid electrode 71 from the outside of the container through the pins 5 described above. A predetermined voltage is supplied to the heater 76 and cathode 73 from the outside of the container through other pins and lead wires. A ground potential is supplied to the second grid electrode 79 from the outside of the container through other pins and lead wire 79*f*. The ground potential supplied to the second grid electrode 79 is also supplied to the focusing electrode 25 which abuts against the cylindrical portion 78, and a container 21 and the container 31 for supporting the focusing electrode 25.

With this arrangement as well, the base 77 of the second grid electrode 79 (electron gun 50) can be positioned in the axial direction correctly and easily. Particularly, since the X-ray tube according to this embodiment is positioned by the second grid electrode 79 integrally molded with it, no fine-positioning error occurs at all when adhering the spacer 8 and second grid electrode 72 to each other, and the positioning precision is further improved when compared to that in the X-ray tube according to the first embodiment.

(Seventh Embodiment)

Figure 10:
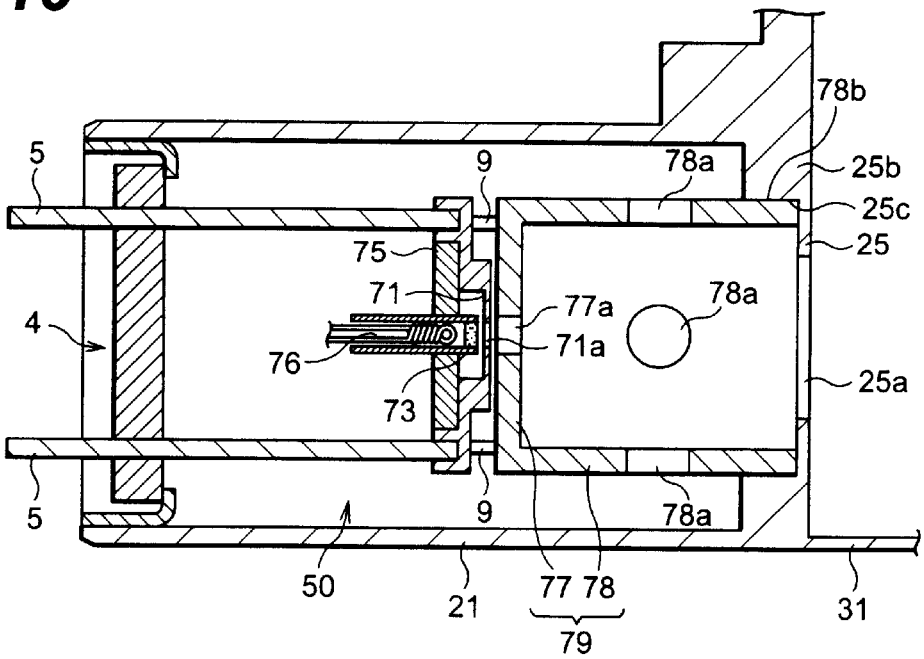
FIG. 10 is a sectional view showing the main part of an X-ray tube according to the seventh embodiment of the present invention.

FIG. 10 is a sectional view showing the main part of an X-ray tube according to the seventh embodiment. The X-ray tube of the seventh embodiment is different from that of the sixth embodiment in that that outer circumferential portion of a focusing electrode 25 which is on the cathode 73 side is formed thick and that an inner circumferential surface 25*c* of this thick-walled portion 25*b* forms a fitting surface which is adapted to fit on the outer circumferential surface of an end 78*b* of a cylindrical portion 78.

The inner circumferential surface 25*c* of the thick-walled portion 25*b* is formed such that its axis coincides with the axes of the constituent components of an electron gun 50 and the axis of an opening 25*a* of the focusing electrode 25.

With the outer circumferential surface of the end 78*b* of the cylindrical portion 78 fitting with the inner circumferential surface 25*c* of the thick-walled portion 25*b*, the end 78*b* of the cylindrical portion 78 abuts against the end face of the focusing electrode 25, in the same manner as in the first embodiment.

With this arrangement, the same effect as that of the third embodiment can be obtained.

In the sixth and seventh embodiments, the second grid electrode 79 is made of, e.g., stainless steel as this is inexpensive. Alternatively, the second grid electrode 79 can be made of other conductors, e.g., a nonmagnetic metal such as aluminum, copper, or the like.

In the embodiments described above, insulating oil is used as the cooling medium. However, the cooling medium is not limited to this and, for example, an insulating gas or insulating cooling medium can be used.

The embodiments described above exemplify a reflection type microfocus X-ray tube as an X-ray tube. However, the present invention is not limited to this, but can also be applied to, e.g., a transmission type microfocus X-ray tube.

Regarding the focal diameter, the present invention is not limited to an X-ray tube with a microfocus, but can be applied to an X-ray tube with any focal diameter.

The X-ray tube according to the present invention can be utilized as an X-ray source and, for example, can be utilized as a light source in an X-ray CT apparatus used for an industrial or medical application.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An x-ray tube comprising:

a housing;

an electron gun provided proximal a grid electrode in said housing;

a focusing electrode integrally formed in said housing;

a spacer having a distal end abutting against said focusing electrode and a proximal end fixed to said grid electrode, said spacer having a predetermined structure allowing electrons directed from said grid electrode toward said focusing electrode to pass through said predetermined structure, wherein said spacer precisely maintains the distance between said focusing electrode and said grid electrode, and said spacer has a hole in a circumferential wall thereof through which an inside and an outside of said spacer communicate with each other; and a stem supporting said electron gun on at least one stem pin, said housing being sealed by said stem.

2. An x-ray tube comprising:

a housing;

an electron gun provided proximal a grid electrode in said housing;

a focusing electrode integrally formed in said housing;

a spacer having a distal end abutting against said focusing electrode and a proximal end fixed to said grid electrode, said spacer having a predetermined structure allowing electrons directed from said grid electrode toward said focusing electrode to pass through said predetermined structure, wherein said spacer precisely maintains the distance between said focusing electrode and said grid electrode; and a stem supporting said electron gun on at least one stem pin, said housing being sealed by said stem;

wherein said grid electrode comprises:

a plate-shaped base portion with an opening, at a center thereof, through which the electrons pass; and a cylindrical portion which is integrally molded with said base portion from the same material as that of said base portion, is formed cylindrical so the electrons directed from said opening toward said focusing electrode can pass therethrough, and has one end abutting against said focusing electrode, characterized in that said cylindrical portion has a hole in a circumferential wall thereof through which an inside and an outside of said cylindrical portion communicate with each other.

* * * * *